US011306911B2

(12) United States Patent
Peek

(10) Patent No.: US 11,306,911 B2
(45) Date of Patent: Apr. 19, 2022

(54) ADJUSTABLE TOPPER FOR A CONTAINER CANDLE

(71) Applicant: Karen Peek, Chesapeake, VA (US)

(72) Inventor: Karen Peek, Chesapeake, VA (US)

( * ) Notice: Subject to any disclaimer, the term of this patent is extended or adjusted under 35 U.S.C. 154(b) by 139 days.

(21) Appl. No.: 16/931,968

(22) Filed: Jul. 17, 2020

(65) Prior Publication Data

US 2021/0018171 A1 Jan. 21, 2021

Related U.S. Application Data

(60) Provisional application No. 62/875,727, filed on Jul. 18, 2019.

(51) Int. Cl.

| | |
|---|---|
| ***F21V 35/00*** | (2006.01) |
| ***F21V 37/02*** | (2006.01) |
| ***F23D 3/18*** | (2006.01) |

(52) U.S. Cl.

CPC ..... *F21V 35/006* (2013.01); *F21V 37/02* (2013.01); *F23D 3/18* (2013.01)

(58) Field of Classification Search

CPC ..... F21V 37/02; F23D 3/18; F21L 19/006

See application file for complete search history.

(56) References Cited

U.S. PATENT DOCUMENTS

| | | | |
|---|---|---|---|
| 6,231,336 | B1 | 5/2001 | Chen |
| D503,003 | S | 3/2005 | Nelson et al. |
| 7,168,948 | B2 | 1/2007 | Swearingen et al. |
| 7,377,772 | B2 | 5/2008 | Thune et al. |
| 2012/0214110 | A1 | 8/2012 | Cagle et al. |

*Primary Examiner* — Jorge A Pereiro

(74) *Attorney, Agent, or Firm* — Billion & Armitage

(57) ABSTRACT

Embodiments of the present disclosure describe materials and methods for stabilizing a flame of a container candle including an adjustable candle topper comprising a topper body capable of being seated over the mouth of a container candle and defining a cavity above the surface of the candle, the topper body having: (1) a centrally disposed opening, and (2) a plurality of radially-disposed guide members extending from the opening to the perimeter of the topper body; and a plurality of adjustment assemblies, each adjustment assembly comprising an abutment member supporting an airflow baffle configured to project into the cavity above the surface of the candle, wherein at least one adjustment assembly is mounted for sliding movement on one of the guide members, whereby the position of the airflow baffle can be adjusted relative to the central opening by sliding the adjustment assembly along the guide member.

20 Claims, 19 Drawing Sheets

ADJUSTABLE TOPPER FOR A CONTAINER CANDLE

This application claims benefit of U.S. Provisional Application No. 62/875,727, filed on Jul. 18, 2019 and which application is incorporated herein by reference. A claim of priority is made.

BACKGROUND

Container candles are well known. In addition to providing a decorative presentation, the walls of the container prevent run-off of candle material when melted by a flaming wick. One disadvantage of container candles is uneven burning. Uneven burning of the candle material can cause a large or flickering flame, sooty smoke, and a tunneling effect in the candle. The size, shape, and composition of the container also affects the burning of wax and wick combinations (see, e.g., FIGS. 2A-C). Wicks can vary greatly in composition and size, both of which affect the ability of the flame to melt and burn the candle. Sooty smoke can deposit as an unsightly carbon residue on the inner walls of the container and surfaces outside the container, be absorbed by melted candle material discoloring it, and detract from the candle fragrance. Tunneling occurs when the flame begins to drop below the top-level of the candle material, leaving a ring of unmelted material (e.g., as shown in FIG. 1). The unmelted candle material is not consumed by the flame, resulting in waste of the candle fuel (e.g., wax or alternative fuel) and dyes, pigments or fragrances retained in the fuel.

There have been attempts to control airflow and retain heat within the container for a more consistent burn, including placing a cover, or candle topper, over the candle (e.g., as shown in FIG. 11). A disadvantage of conventional candle toppers is that they are generally constructed for use with a single type of container or a particular container mouth. While conventional candle toppers can have a variety of decorative forms, the forms are generally rigid and the size of any openings is fixed. Fixed openings do not permit control over the rate of burning for candles other than those it was designed to be used with. For example, a conventional topper for use with a single wick pillar candle, may cause a candle with two or more wicks to burn too quickly. Fixed openings cannot be adjusted in response to changes in drafts or the diminishing height of the candle. Furthermore, when placed atop a container that is smaller or has a different wall geometry than the container for which it was designed, conventional candle toppers may not control air flow around the wick and may be unstable over the smaller mouth.

Thus, there is a need in the art for candle toppers with adjustable features that improve the user experience of the candle and provide substantially even burning of various types of candle in various containers.

SUMMARY

The present disclosure relates to an adjustable topper capable of controlling airflow around a wick or wicks of variously sized and shaped container candles. For example, materials related to a candle topper configured to be adjusted by a user to control airflow and heat reflection around or above the candle flame are provided. In some cases, an adjustable topper described herein can enhance a user's enjoyment of a container candle. For example, an adjustable topper described herein can be used to ensure the candle over which the topper is positioned burns evenly, minimizing smoke production, soot deposit on the container walls, and waste of candle materials.

In general, the present disclosure features an adjustable topper for a container candle, the topper comprising: a topper body capable of being seated over a mouth of a container candle and defining a cavity above the surface of candle, the topper body having: (1) a centrally disposed opening; and (2) a plurality of radially-disposed guide members extending from the opening to the perimeter of the topper body; and a plurality of adjustment assemblies, each adjustment assembly comprising an abutment member supporting an airflow baffle configured to project into the cavity above the surface of the candle, wherein at least one adjustment assembly is mounted for sliding movement on one of the guide members, whereby the position of the airflow baffle in the cavity can be adjusted relative to the central opening by sliding the adjustment assembly along the guide member to stabilize a flame from the candle. The topper body can have a substantially arcate cross-section defining a domed cavity above the surface of the candle. The airflow baffle can rise from the abutment member at a curve parallel to the substantially arcate rise of the topper body. The airflow baffle can have a semioval shape. Each guide member can include a radially-extending slot, and the abutment member can be coupled to a lug mounted on the surface of the guide member through the slot. In some cases, a connector threads the slot and operably couples the lug and the abutment member. At least a portion of the connector can be configured to mount the side wall of the container. The topper body can further include a plurality of fenestrations. The topper body can further include a flange. The airflow baffle can have a substantially arcate profile. Each abutment member can be configured to support a pair of the airflow baffles. The abutment member can be configured to abut an inner side wall of a container having a mouth of smaller area than the area defined by the perimeter of the topper body. The perimeter of the topper body can be substantially circular. In one or more of the embodiments described above, the abutment member can be configured as an arc of a circle having a radius that is shorter than the radius of the perimeter of the topper body and the midpoint of the arc is operably coupled to a lug mounted on the surface of the guide member through a slot defined by the guide member. In one or more embodiments described above, one or both of the guide member and the lug are configured to resist sliding without an application of manual force. The adjustment assembly can be configured such that sliding movement in the direction of the central opening results in at least a portion of the airflow baffle being visible through the central opening when viewed from above. The topper body can include at least three radially-disposed guide members extending from the opening to the perimeter of the topper body and at least three adjustment assemblies, wherein each adjustment assembly is mounted for sliding movement on one of the guide members. In one or more of the embodiments described above, the perimeter of the topper body is substantially circular and the abutment members are configured as substantially equal arcs of a circle having a radius that is shorter than the radius of the perimeter of the topper body. In one or more of the embodiments described above, the midpoint of each arc is operably coupled to a lug mounted on the surface of the guide member through a slot defined by the guide member.

Another embodiment of the present disclosure is an adjustable candle topper kit comprising: a container candle having at least one side wall defining a mouth, and an adjustable topper comprising: a topper body capable of being seated over the mouth of the container and defining a cavity above the surface of the candle, the topper body having: (1) a centrally disposed opening; and (2) a plurality of radially-disposed guide members extending from the opening to the perimeter of the topper body; a plurality of adjustment assemblies, each adjustment assembly comprising an abutment member supporting an airflow baffle configured to project into the cavity above the surface of the candle, wherein at least one adjustment assembly is mounted for sliding movement on one of the guide members, whereby the position of the airflow baffle in the cavity can be adjusted relative to the central opening by sliding the adjustment assembly along the guide member.

The details of one or more examples are set forth in the description below. Other features, objects, and advantages will be apparent from the description and from the claims.

BRIEF DESCRIPTION OF DRAWINGS

This written disclosure describes illustrative embodiments that are non-limiting and non-exhaustive. In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

Reference is made to illustrative embodiments that are depicted in the figures, in which.

Figure 1:
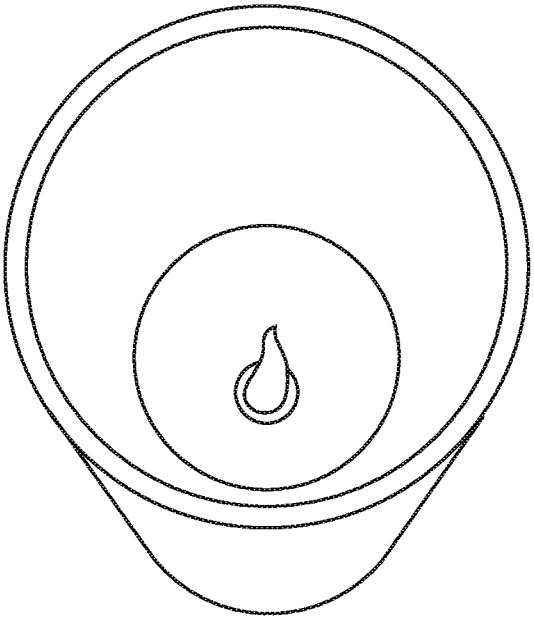
FIG. 1 a is photograph of a container candle showing tunneling of the candle material, with incomplete melting of the candle material close to the container wall due to uneven burning.
Figure 2A:
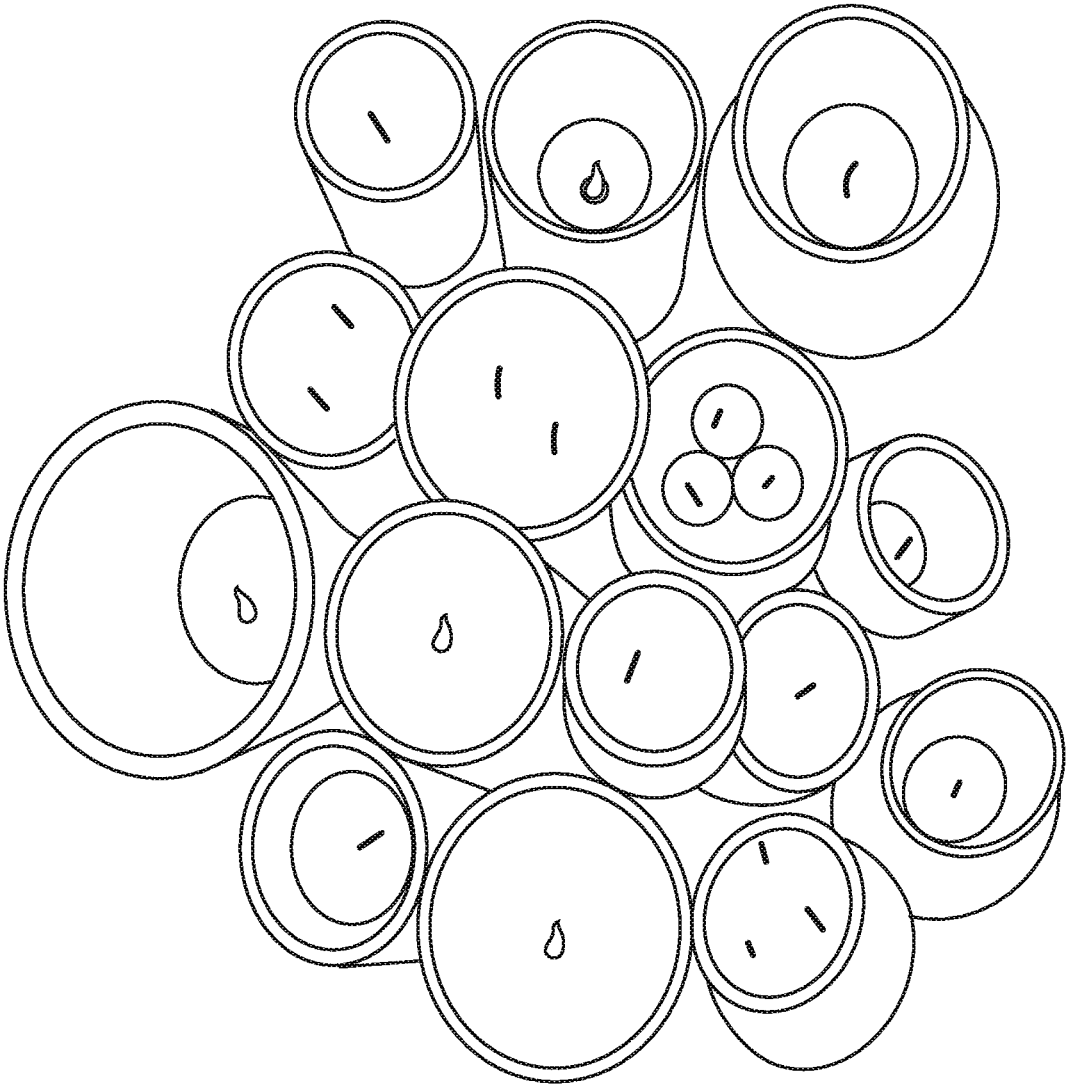
FIGS. 2A-C are photographs of a plurality of container candles with various dimensions and shapes. (A) shows a top view of fifteen different container candles; (B) shows a side view of five different container candles; and (C) shows a top view of the container candles of B.
Figure 2B:
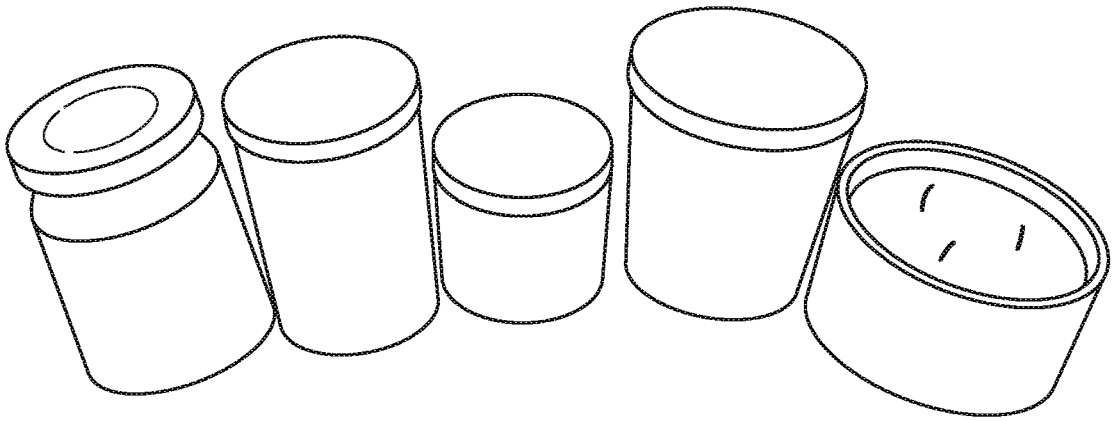
Figure 2C:
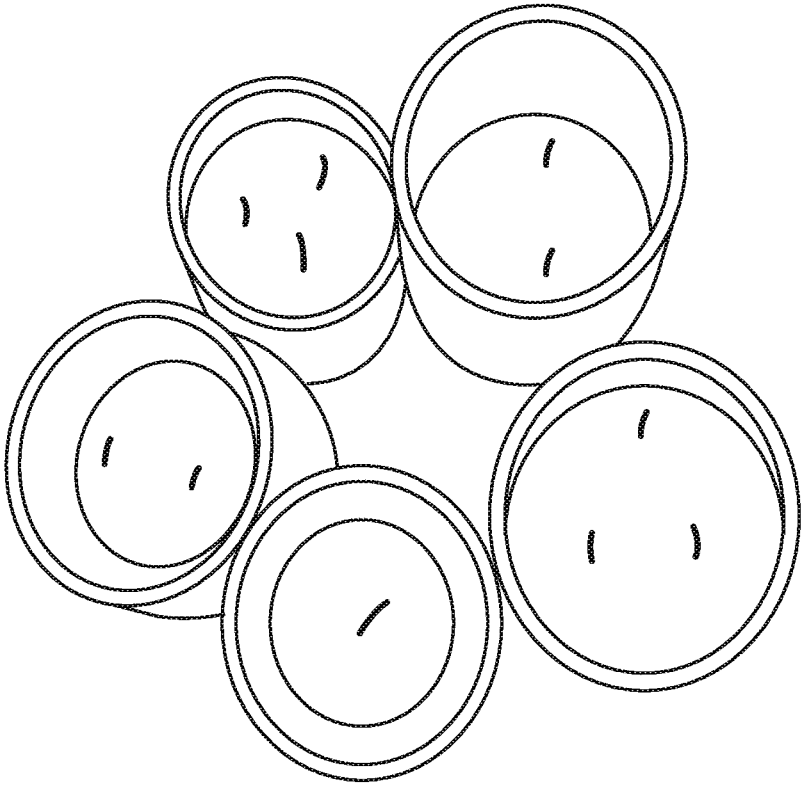

The application file contains at least one drawing executed in color. Copies of this patent or patent application publication with color drawing(s) will be provided by the Office upon request and payment of the necessary fee.

DETAILED DESCRIPTION

Embodiments of the present disclosure describe methods and materials for adjustably stabilizing the flame of a container candle. For example, this disclosure describes adjustable candle toppers configured to be stably mounted over the mouths of container candles of various sizes and shapes. In some cases, an adjustable candle topper described herein can feature a topper body capable of being seated over a mouth of a container candle and defining a cavity above the surface of the candle, the topper body having (1) a centrally disposed opening; and (2) a plurality of radially-disposed guide members extending from the opening to the perimeter of the topper body; and a plurality of adjustment assemblies, each adjustment assembly comprising an abutment member supporting an airflow baffle configured to project into the cavity above the surface of the candle, wherein at least one adjustment assembly is mounted for sliding movement on one of the guide member, whereby the position of the airflow baffle in the cavity can be adjusted relative to the central opening by sliding the adjustment assembly along the guide member to stabilize a flame burning the candle.

Definitions

The terms recited below have been defined as described below. All other terms and phrases in this disclosure shall be construed according to their ordinary meaning as understood by one of skill in the art.

As used herein "candle" refers to a tapered, molded or containerized body of meltable solid or semi-solid fuel such as a wax (e.g., paraffin, vegetable, or beeswax) and/or a gelled fuel, into which one or more wicks has been placed so that as the wick is burned, the fuel melts and thereby provides liquid fuel for the wick to burn.

As used herein "candle material" refers to the candle fuel (e.g., wax and/or gelled fuel), wick(s), dye(s) or pigment(s), and/or fragrance(s) in the fuel.

As used herein with reference to the flame of a candle, "stabilizing" refers to minimizing flame movement and flickering or flame disruption.

As used herein, "container candle" refers to candles formed by pouring melted wax into a container having a wick disposed therein, molded candles that have been placed into an open mouthed container, and tapered and molded candles over which an opened mouthed container has been placed.

As used herein, "mouth" refers to the opening leading out of or into the cavity of a container, such as the cavity of a container candle above the candle material.

As used herein, "neck" refers to the slender part near the top of a jar, such as an apothecary jar, a hurricane glass vase or candle holder, or other container.

An adjustable candle topper of the present disclosure is intended to be configured for use with any container candle regardless of shape, wick configuration or dimension. While illustrated with cylindrical candles and containers, this is for simplicity of explanation and illustration. An adjustable topper as described herein will be adjustable for use with a number of differently sized and shaped containers within a range of pre-determined outside mouth widths. For example, an adjustable candle topper of one or more embodiments described herein can be configured for adjustable use with votive candle containers having an outer mouth diameter of about 2 to about 4 inches, such as votive candles having an outer mouth diameter of 2.5 to 4 inches, 2 to 3.5 inches, 2 to 2.5 inches, or 2 to 2.25 inches; tumbler candle containers having an outer mouth diameter of about 3 to about 5 inches, such as 3 to 4 inches, 3.5 to 4 inches, 4 to 5 inches, and 4.5-5.5 inches; pillar candle containers having an outer mouth diameter of about 2 to about 6 inches, such as 2 to 3 inches, 3.5 to 4 inches, 4 to 4.5 inches, 5 to 5.5 inches, or 5.5 to 6 inches; jar candle containers such as apothecary, hex, 12-sided, canning or jelly jar containers, and cube containers with a perimeter of about 4×4 inches, about 3.5×3.5 inches, or about 3×3 inches.

Typically, the container of a container candle is made of glass, but other non-combustible materials can be used. Glass can permit illumination of the candle through the walls of the container and provide additional aesthetic value.

FIGS. 3-4 illustrate an adjustable candle topper according to one or more embodiments of the present disclosure. In reference to FIGS. 3A-D, an adjustable candle topper 10 for use with a container candle according to one or more embodiments of the present disclosure exhibits radial symmetry about a central axis and includes topper body 12 configured to be removably mounted over a substantially circular mouth of a container candle and to stabilize the candle flame when lit. Topper body 12 has a wheel-shaped conformation with spokes 13*a* and 13*b*, and a substantially circular perimeter. Spoke 13*a* is solid, however, this element can have apertures. Alternatively, all spokes 13*a* can be omitted. In some cases, a candle topper body can be formed with fewer or more spokes based on the amount of structural support required for the integrity of the topper body, and other perimeter shapes, such as substantially square, substantially rectangular, or other polygon (e.g., triangle, pentagon, hexagon, heptagon and the like), based on the mouth of the types of containers on which the candle topper will be mounted.

Topper body 12 can be formed from any heat-resistant material, such as glass, metal, ceramic, or heat-stable or fire-safe plastics and composites thereof. Although an opaque body is shown, a topper body of the present disclosure can be wholly or partially constructed of transparent, translucent, or opaque material. The topper body can be formed from a single type of a material, or assembled from pieces formed from various materials. For example, the perimeter can be formed of one type of metal and the spokes can be formed from another type of metal or heat-resistant plastic and the separate parts can be soldered or otherwise bonded together to form a unitary body. The perimeter can include mounting bosses or feet for support on the rim of the container. In some cases, the topper body can include a surface treatment to provide a decorative effect (e.g., enamel) or a protective layer. A topper body can be made of generally non-conductive material and then undercoated with a thermally reflective surface for accelerated or more complete melting.

Figure 3A:
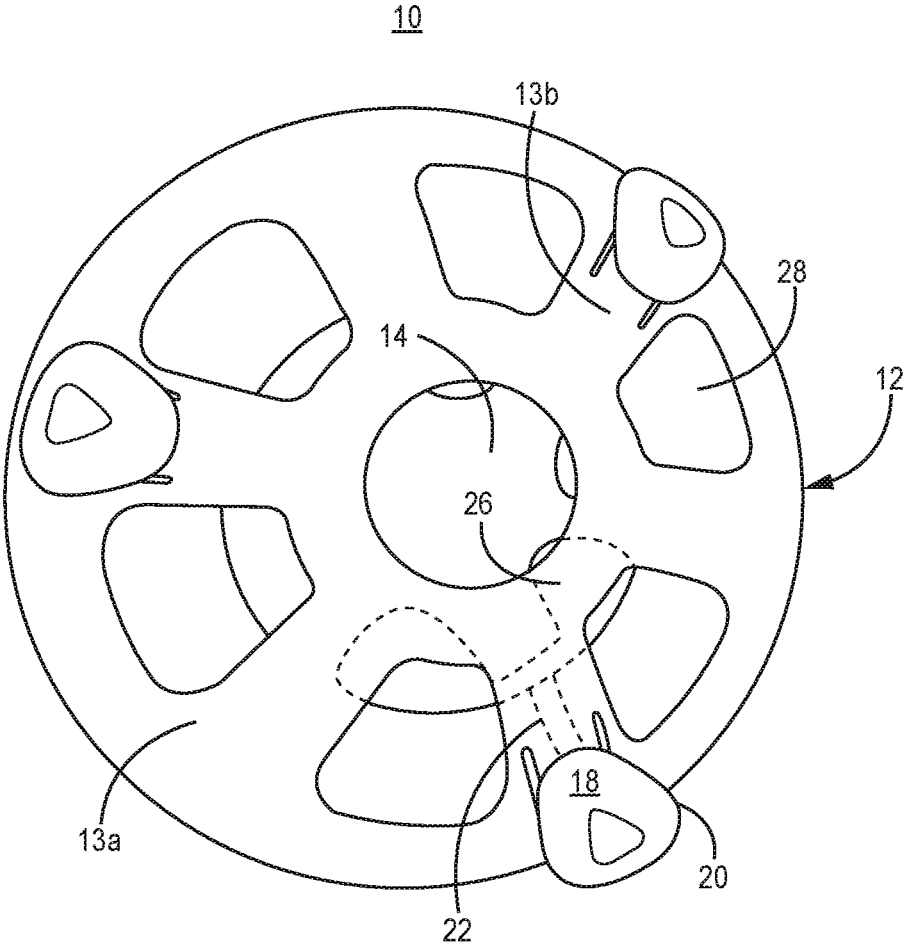
FIGS. 3A-D show illustrations of partial perspective views of an adjustable candle topper without a container candle, according to one or more embodiments of the present disclosure. (A) shows a partial perspective top view of an adjustable candle topper; (B) shows a different perspective top view of A; (C) shows perspective side view of A; and (D) shows an enlargement of a partial perspective top view of the adjustable candle topper of A, featuring a lug of an adjustment assembly mounted on a guide member at an alternative position to the position shown in A.
Figure 3B:
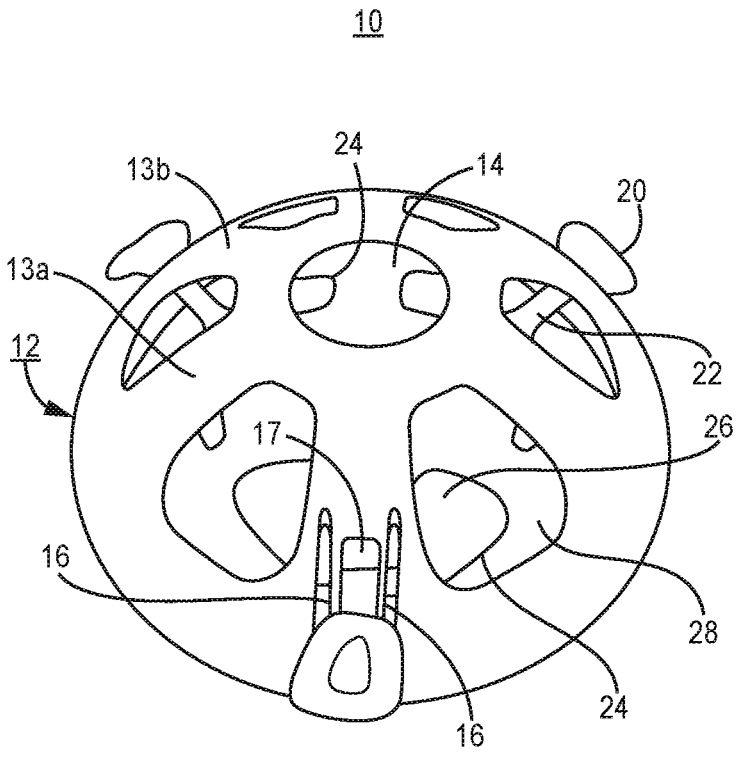
Figure 3C:
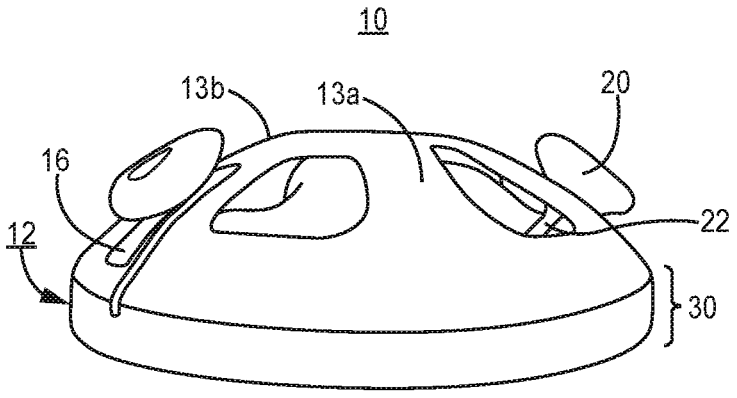
Figure 3D:
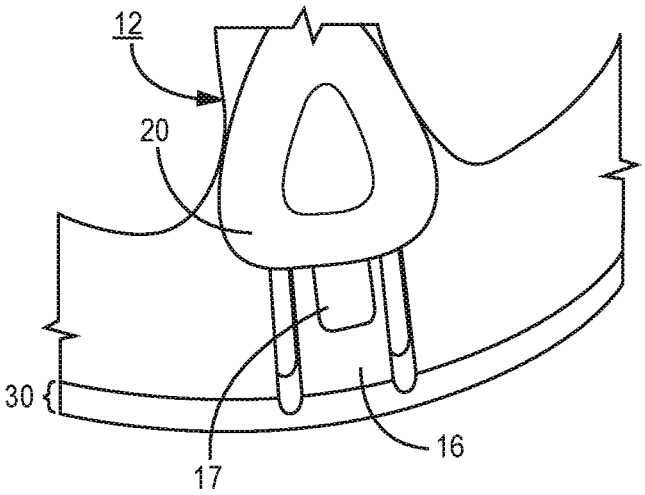

Topper body 12 is constructed of one or more sufficiently thin pieces of material to define a cavity directly above the candle and above of the rim of the container. As shown in FIGS. 3B-C, topper body 12 is generally dome shaped with a substantially arcate profile defined by the angle from which the spokes rise from the perimeter. The curvature of the arcate profile is defined by the degree of curvature, or the central angle formed at the intersection of a line drawn from the perimeter and a line drawn from a position on the arc to the center of the topper. The rise of the spokes from the perimeter can have any degree of curvature, and the skilled artisan can select a suitable degree based on the dimensions of the candle topper (e.g., height and diameter) and the expected size of the flame. In some cases, topper body 12 includes flange 30 forming a rim at the perimeter of topper body 12. Flange 30 can be capable of removably engaging the outer wall of the mouth of a container. Flange 30 can be any height and can include an inner surface configured to provide a friction or snap fit with the outer wall of a container or configured with grooves for engaging a mouth of a mason jar container or other threaded container.

The domed cavity formed by topper body 12 can provide benefits for radiating heat toward the candle for uniform melting, but an arcate profile is not necessary to realize all the advantages of a candle topper of the present disclosure. In some cases, a topper body does not have an arcate profile. For example, the rise of the body can be a substantially straight line from the perimeter or upper portion of the flange. A topper body can have a frustoconical shape of any suitable height for the diameter of the circular perimeter. Alternatively, a topper body can have square perimeter and a truncated pyramidal shape of any suitable height for the dimensions of the perimeter.

Topper body 12 includes several openings providing airflow to the candle: a central opening 14 and a plurality of fenestrations 28. Central opening 14 is positioned at a substantially central portion of topper body 12, and is formed by an annular portion of topper body 12, substantially concentric with the perimeter. Central opening 14 functions to vent heated air upwardly from the burning candle, to limit airflow around the wick, and to permit combustion of the wick and candle material. Generally, a central opening of a candle topper as disclosed herein has substantially the same shape as the perimeter of the topper body. In the embodiment shown, central opening 14 is substantially circular. The size of the central opening is selected to provide sufficient oxygen to the flame of the widest container on which candle topper 10 can be mounted. For example, a suitable diameter of central opening 14 for a standard apothecary jar container candle is generally in the range of 0.5 to 10 inches. A central opening can be defined by a more elaborate decorative border formed by a pattern of various or recurring shapes which are carved, stamped, pierced, or otherwise cut into a topper body (see, for example, FIGS. 8A-D, showing central openings formed by irregularly shaped borders defined by the edges of leaves or the edges of a repeating pattern of cats, dogs, and hearts ((A) and (D) respectively), a circular scalloped border (B) and a trefoil border (C)). Six substantially identical trapezoidal fenestrations 28 are shown, however, other patterns, numbers, and shapes can be provided based on the desired degree of air and heat flow and the material forming the topper body. For example, larger or more fenestrations can permit greater airflow, increase the amount light and heat radiated from the mouth of the container, and reduce the amount of heat radiated back towards the candle material when burning, whereas smaller fenestrations can permit airflow, ensure the topper body has strong structural support, and prevent foreign objects from being placed through the fenestrations. A regular pattern of fenestrations can distribute the weight of candle topper 10 uniformly over the container candle. The number and shape of fenestrations can be optimized to balance aesthetic qualities and functional/structural qualities of the topper.

Topper body 12 further includes a pair of narrow elongate openings in each of spokes 13*b* which define guide member 16 as parallel guide rails running longitudinally down a distal portion of spoke 13*b*. Guide member 16 has the same curvature as topper body 12. The narrow elongate openings extend along the length of spokes 13*b* from about mid-point to the topper body perimeter. Portions of spoke 13*b* and guide member 16 define connector slot 17. Connector slot 17 extends medially along the length of spoke 13*b* and parallel to each narrow opening. As the skilled artisan will infer from FIGS. 3B and 3D, connector slot 17 has a substantially rectangular border and is shorter in length than the narrow openings, however, other shapes and lengths can be utilized based on the degree of adjustment desired and discussed further below. Guide member 16 and connector slot 17 provide a travel path for the adjustable components of candle topper 10.

Adjustable candle topper 10 also includes three radially positioned and equally spaced adjustment assemblies 18. Each adjustment assembly 18 is mounted on and through topper body 12 and configured for sliding engagement along guide member 16. Adjustment assembly 18 is configured to adjustably stabilize candle flame and air flow in and around a candle wick, and may also secure candle topper 10 to the rim or inner wall of a container. While candle topper 10 has three adjustment assemblies 18, fewer or more adjustment assembles can be used depending on the shape or width of the container mouth. For example, for a rectangular candle mouth, a candle topper according to the present disclosure can have at least two adjustment assemblies in generally opposing positions, whereas a wider candle topper can have five or more radially positioned adjustment assemblies.

Each adjustment assembly 18 includes lug 20, connector 22, and abutment member 24. The components of adjustment assembly 18 can be constructed from a single type of material or several different types of material, as discussed above with respect to the material for constructing a topper body. In some cases, a lug, connector, and abutment member are made of the same type of material as the topper body with which they will be used. Alternatively, a lug and connector can be made of a non-conductive material, and an abutment member can be made of a heat conducting or heat reflecting material.

Connector 22 threads (or passes through) guide member 16 longitudinally via connector slot 17 and can have any configuration suitable for sliding movement within connector slot 17 and for connecting lug 20 to abutment member 24. Connector 22 can also be configured for removably mounting topper body 12 on the rim of a container. For example, candle topper 10 can be seated on a container using a portion of connector 22 as a mounting foot, or using the narrow space formed at the intersection of connector 22 and guide member 16 to restrict movement of topper body 12 over the mouth of the container.

Lug 20 has a substantially triangular shaped body and is centrally mounted at a terminus of connector 20, with the narrowest point directed toward central opening 14. At least a portion of lug 20 rests upon the upper surface of opposing sides of guide member 16. Other shapes and mounts can be used, however. For example, lug 20 can be configured as a cantilevered, or otherwise anchored body having a shape or feature sufficiently wide for spanning connector slot 17 to contact a portion of opposing sides of guide member 16. The material of one or both of lug 20 and guide member 16 can be adapted for sliding movement of lug 20 upwards and downwards along the curve of topper body 12. The material of one or both of lug 20 and guide member 16 can be adapted to resist sliding without an application of manual force (e.g., sliding friction), and thereby ensure that the lug 20, once positioned to a desired height remains at that height until it is manually moved again.

Lug 20 is operably coupled to abutment member 24 by connector 22. Connector 22 connects to abutment member 24 at a site that approximates the mid-point of abutment member 24. Abutment member 24 has a curved configuration rendering it capable of abutting at least a portion of an inner wall of a container candle having a smaller diameter than perimeter of topper body 12. In the case of a topper body having a truncated pyramidal body, an abutment member can be substantially straight (e.g., where the guide member is positioned on the faces of the topper body), or configured to fit into a corner by having a central bend of about 90° (e.g., where the guide member is positioned at the edges of the topper body).

A pair of baffles 26 extend from and are supported by abutment member 24. The connection site of connector 22 defines a central axis about which the pair are substantially bilaterally symmetrical. Each baffle 26 is positioned distally from connector 22 on abutment member 24, with the most distal portion of each baffle 26 being continuous with the distal edge of abutment member 24. As shown, baffle 26 has an arcate profile that rises from abutment member 24 at a substantially parallel curve to the curvature of topper body 12. Where a topper body has a frustoconical shape or truncated pyramidal shape, a suitable rise of a baffle can be parallel to the rise of the topper body or have a shallower slope than the topper body. In some cases, an abutment member can have a single baffle (e.g., where the topper body is a truncated pyramid with guide members positioned on its faces), or more than two baffles (e.g., a third baffle positioned centrally).

The shape of baffle 26 is configured to baffle airflow through fenestrations, restrict heat flow from the candle through central opening 14 and/or reflect heat back towards the candle material. Baffle 26 has a semi-ovate petal shape (i.e., semioval) when viewed from above or below, with the narrowest point of the semioval directed toward the central axis of candle topper 10. The shape, size and placement of baffle 26 on abutment member 24 allows it to travel within the cavity underneath topper body 12 along a path defined by guide member 16, i.e., inwardly/upwardly or outwardly/downwardly, without interfering with the travel of an adjacent baffle. Other shapes sized to travel as described above can be utilized for a baffle such as an oblong, obtuse, or acute petal shape.

The size and shape of abutment member 24 is configured so that, when all three lugs 20 are positioned at the upper stop of connector slot 17, at least a portion of the distal edges of adjacent abutment members 24 align and the distal edges of their respective baffle 26 are brought into close contact on a transverse plane below the border of central opening 14. In this position, when candle topper 10 is in an upright position and viewed from above, at least a portion of the furthest projecting edge of each baffle 26 can be visible through central opening 14. In some cases, each of lugs 20 can be positioned so that the lateral edges of all three abutment members 24 fit together to form an annular rim in a transverse plane underneath topper body 12. Here, each abutment member 24 is configured as one-third of the circumference of a circle with a radius that is shorter than the radius of the perimeter of topper body 12. The position of the upper stop of connector slot 17 on spoke 13*b* can be based upon the diameter of this annular rim.

A user can manipulate the position of adjustment assembly 18 to improve burn efficiency over a single type of container, or over various differently sized containers and/or candles. For example, candle topper 10 can be mounted over a lit container candle having a rim that is coextensive with the perimeter of topper body 12. When first lit, the candle flame or flames can be relatively small, and adjustment assembly 18 can be positioned to increase the amount of heat reflected back to the candle material by manually pushing lug 20 to slide on the path defined by guide means 16 towards central opening 14. This movement results in the connector 22 traveling from its first position within connector slot 17 to a second position based on the location of the wick or wicks. The process can be repeated until all lugs 20 are at the same position, however, the position of each lug 20 can be independently controlled for adjusting airflow through a single portion of topper body 12. Once the candle has reached the desired burn rate, adjustment assembly 18 can be repositioned to reduce the amount of heat by pulling lug 20 towards the lower stop of connector slot 17. If the user notices that some of the melted candle material is pooling (e.g., due to a draft or some other flame disturbance) adjustment assembly 18 can be repositioned again to ensure even melting of the candle material and efficient burning.

The adjustability described above allows a candle topper of the present disclosure to be used with container candles smaller than the perimeter of topper body 12 or container candles having a different rim or side wall geometry than the perimeter of topper body 12. For example, a candle topper according to one or more embodiments of the present disclosure can have a perimeter configured for use with a 5 inch diameter container and have a central opening diameter sized for the candle (about 2 inches). A prior art topper having a similarly dimensioned body could be positioned so that a more central portion of the topper balances on the rim of a 2.5 inch diameter container but the candle may not burn efficiently as, due to the size of the central opening, a substantial portion of the container mouth will not be covered by the prior art topper body. However, using an adjustable candle topper of the present disclosure, baffles can be moved into position over the mouth of the smaller container and thereby can stabilize the flame to limit or prevent tunneling.

Returning to candle topper 10, a user can adjust all lugs 20 to the upper stop of connector slots 17 and mount candle topper 10 centrally over the mouth of a container candle having a diameter that is smaller than the diameter of topper body 12. Then the user can manually slide one lug 20 down along the path defined by guide means 16. This movement results in connector 22 traveling from its first position within connector slot 17 to a second position suitable for engaging the rim of the container at the desired height. In some cases, the desired stop is coincident with abutment member 24 contacting the inner wall of the container. If both a portion of connector 22 and abutment member 24 abut the rim and inner wall, further stabilization of candle topper 10 can be achieved over the mouth of the container candle. Due to the operable connection of lug 20 and abutment member 24, baffle 26 will be positioned closer to the central axis of topper body 12 over the candle material. The process can be repeated until each abutment member 24 is in contact an opposing portion of the inner wall, or until each connector 22 makes contact with the container rim at the desired height. Although an outer portion of topper body 12 extends outside the container candle side wall, candle topper 10 is stably mounted on the container. Due to the position of baffles 26, the movement of heated air is relatively restricted through central opening 14, resulting in a relative increase in the amount of heat reflected toward the surface of the candle material and less turbulence over the mouth of the container, than would be observed in the absence of adjustment assembly 18. The reflected heat ensures that the surface of the candle material melts uniformly for efficient candle combustion and less waste.

Figure 4A:
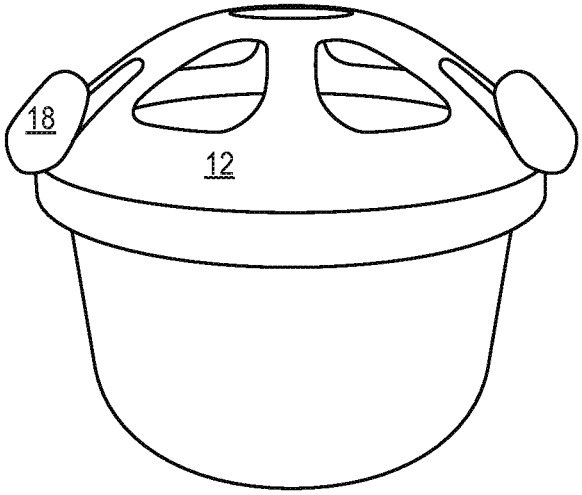
FIGS. 4A-K show photographs of an adjustable candle topper according to one or more embodiments of the present disclosure positioned on container candles of various sizes. (A) shows an angled side view of an adjustable candle topper as disclosed herein positioned on a large diameter container candle; (B) shows an angled top view of A; (C) shows an angled side view of the adjustable candle topper of A and B on a 2-wick tumbler candle; (D) shows an angled top view of C; and (E) shows a top view of C. (F) shows an angled side view of the adjustable candle topper of A-E positioned on a 3-wick tumbler candle; (G) shows an angled top view of F; (H) shows an angled side view of the adjustable candle topper of A-G on a jar candle; (I) shows an angled top view of H; (J) shows an angled side view of the adjustable candle topper of A-I a narrow single wick pillar candle; (K) shows an angled top view of J.
Figure 4B:
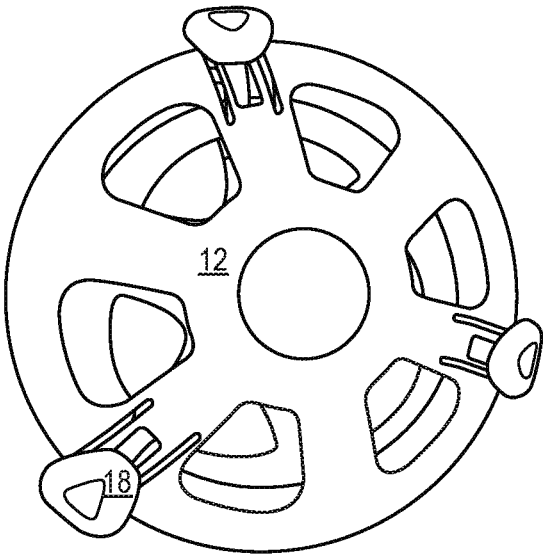
Figure 4C:
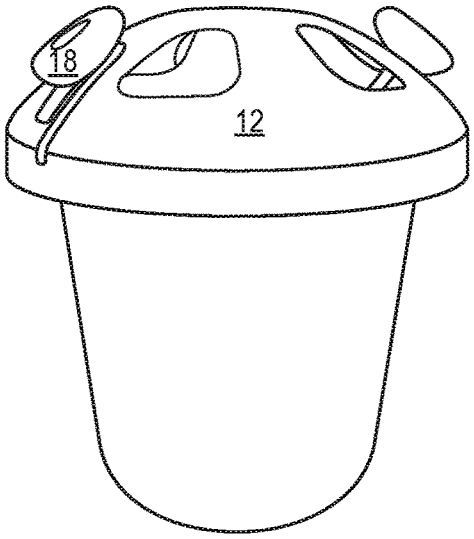
Figure 4D:
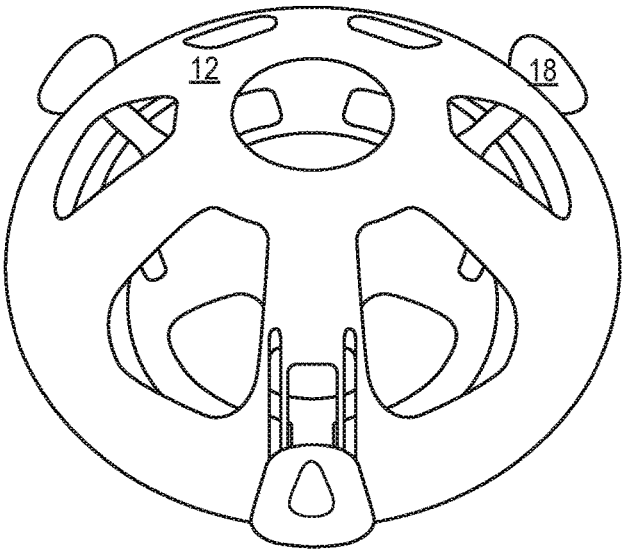
Figure 4E:
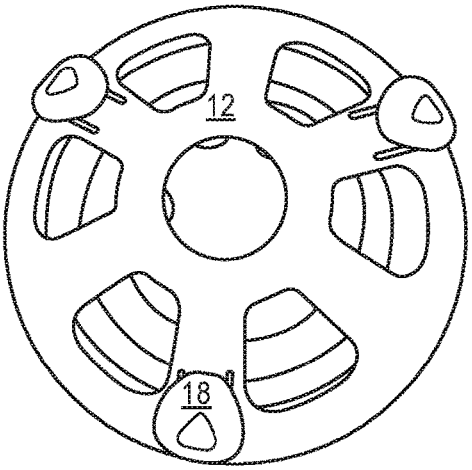
Figure 4F:
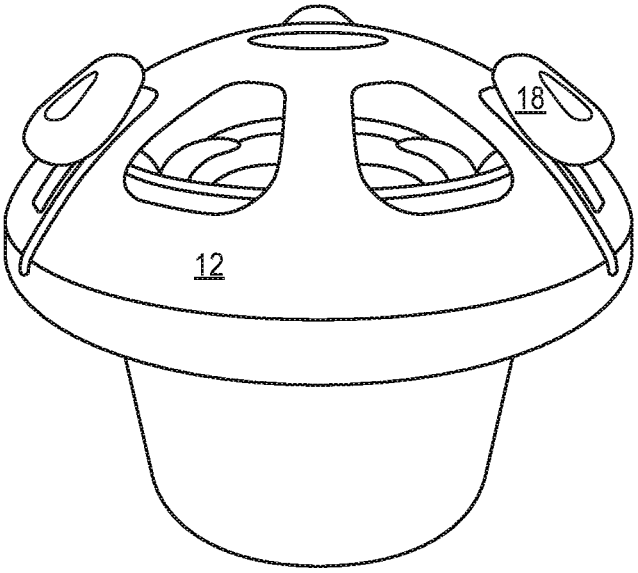
Figure 4G:
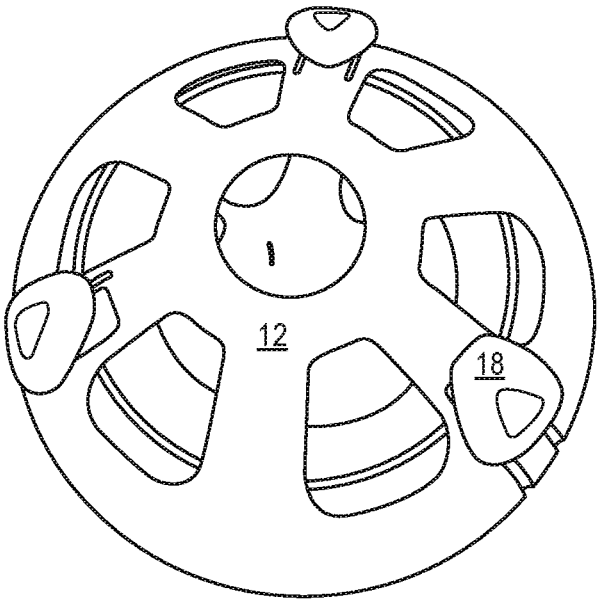
Figure 4H:
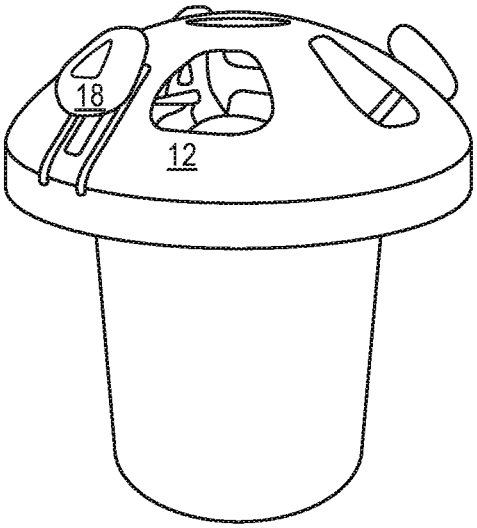
Figure 4I:
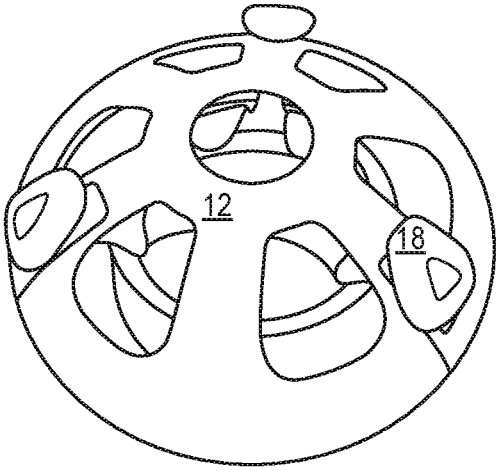
Figure 4J:
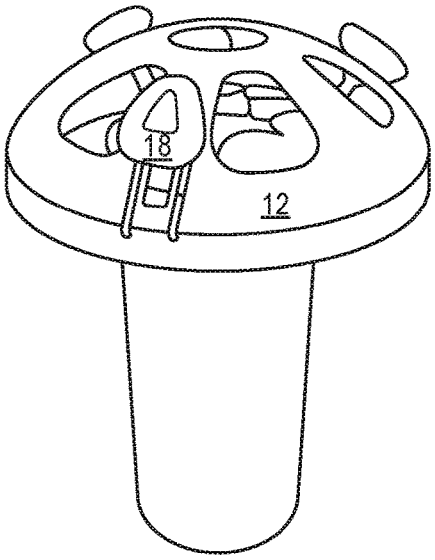
Figure 4K:
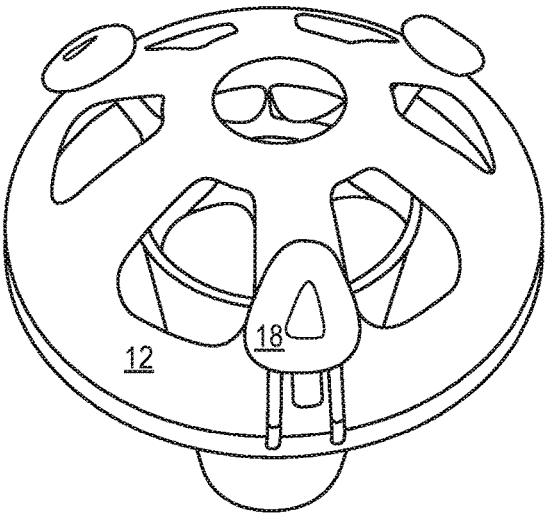

FIG. 4A-K show views of candle topper 10 on variously sized container candles. FIGS. 4A-B show two views of adjustment assembly 18 at the lowest position over a wide container having an outer diameter of approximately the same as the diameter of topper body 12. FIGS. 4C-E show three views of adjustment assembly 18 adapted to form a tripod mount for topper body 12 on a tumbler container candle with a portion each connector 22 abutting the rim of the container wall. FIGS. 4F-G show two views of adjustment assembly 18 adapted to mount topper body 12 on a tumbler container candle with an outer diameter smaller than topper body 12. FIGS. 4H-I show two views of adjustment assembly 18 adapted to form a tripod mount on a jar container candle with a neck having an outer diameter smaller than topper body 12. FIGS. 4J-K show two views of adjustment assembly 18 adapted to align the distal ends of the abutment members as an annular rim abutting the inner wall of a pillar container of smaller diameter than topper body 12.

Figure 5A:
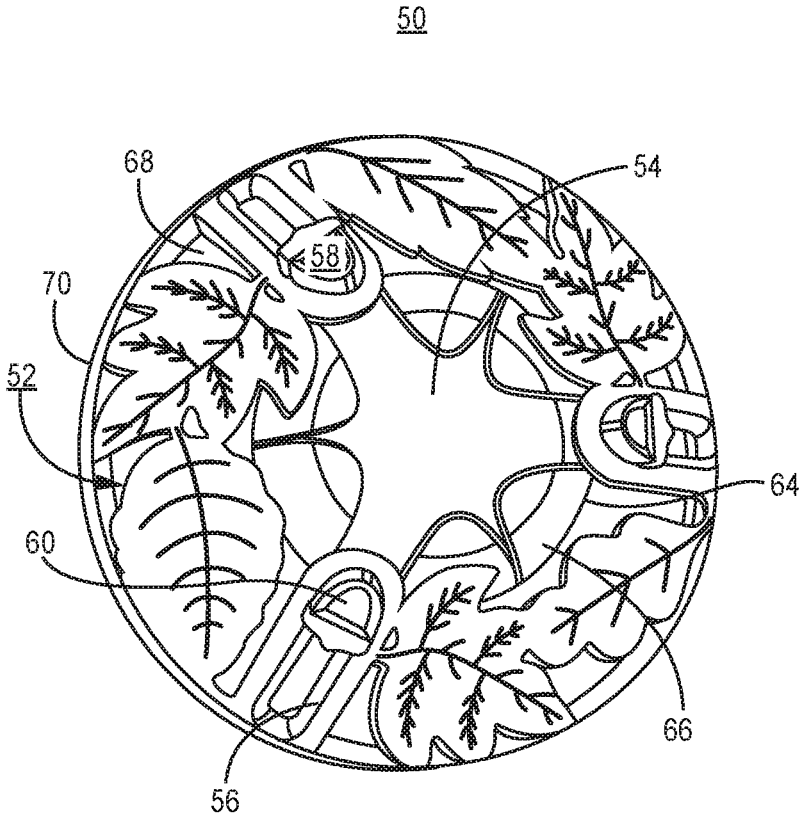
FIGS. 5A-B show 3-D illustrations of various views of an adjustable candle topper without the candle, according to one or more embodiments of the present disclosure. (A) shows a top view of a decorative adjustable candle topper as disclosed herein; and (B) shows a bottom view of the decorative adjustable candle topper of A.
Figure 5B:
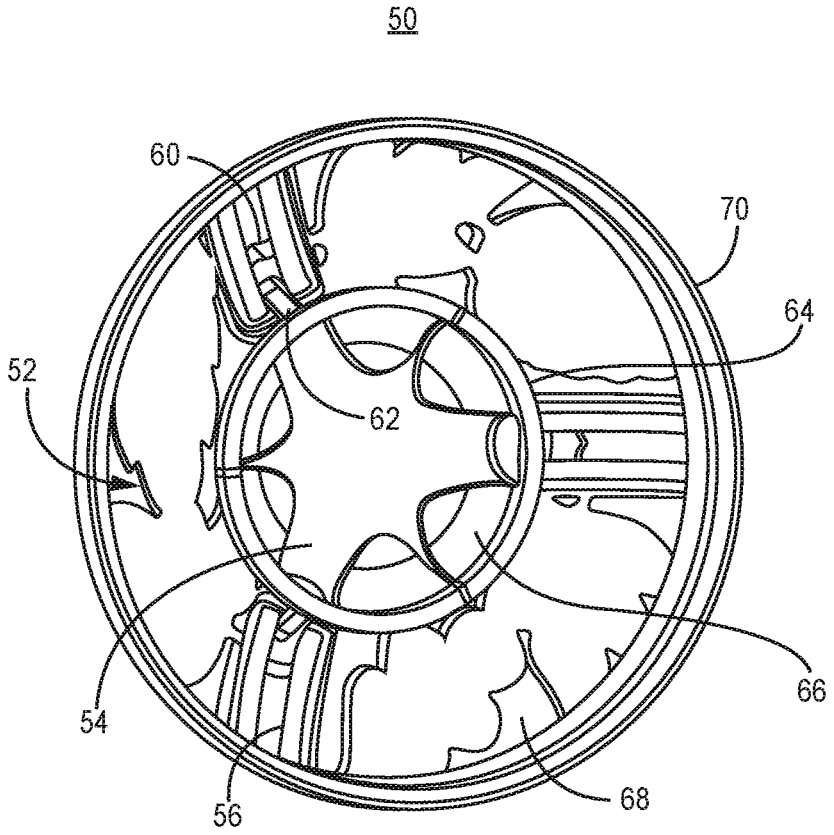
Figure 6C:
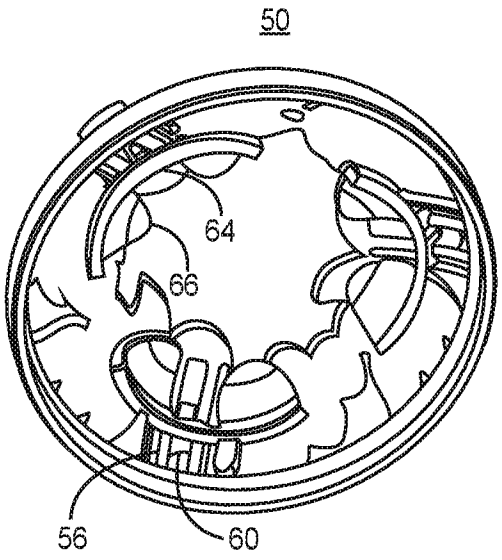
FIGS. 6A-C show 3D illustrations of a bottom view of the adjustable candle topper of FIG. 5 adjusted to different positions: (A) at the highest position; (B) a lower position than and (A); and (C), a lower position than in (B).
Figure 6B:
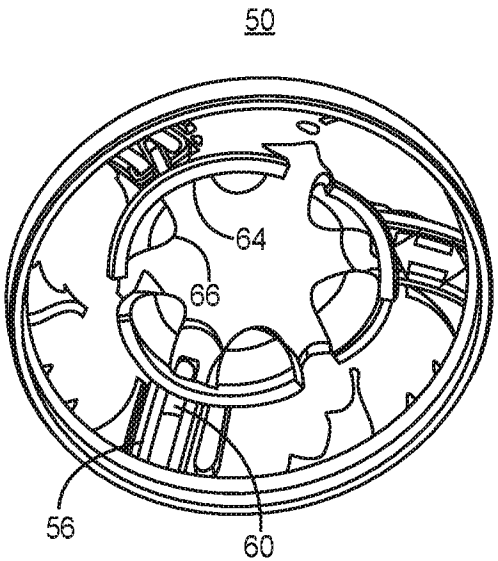
Figure 6A:
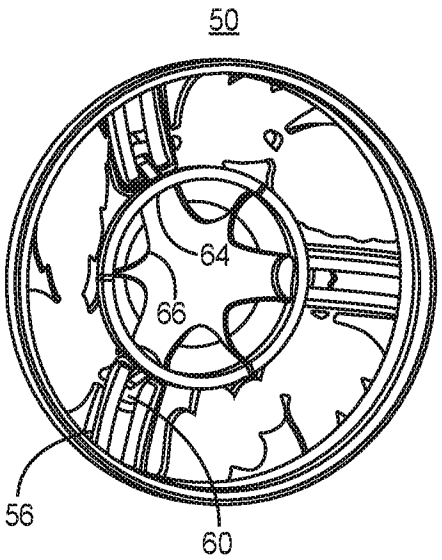

FIGS. 5-6 illustrate an adjustable candle topper according to one or more further embodiments. In reference to FIGS. 5A-B, decorative adjustable candle topper 50 for use with a container candle according to one or more embodiments of the present disclosure exhibits radial symmetry about a central axis and includes decorative topper body 52 configured to be removably mounted over a substantially circular mouth of a container candle and to stabilize the candle flame when lit. Decorative topper body 52 features three different design elements of two leaves each, joined by three guide members 56. Decorative topper body 52 is constructed of metal, however any of the materials discussed above for topper body 12 can be used. Decorative topper body 52 is affixed to flanged ring 80, which defines the circular perimeter of decorative candle topper 50.

Guide members 56 are configured as inverted U bends with a beveled inner edge that defines connector slot 57. Other shapes and lengths can be utilized based on the degree of adjustment desired and discussed further below. Guide member 56 and connector slot 57 provide a path of travel for the adjustable components of decorative candle topper 50.

Figure 8A:
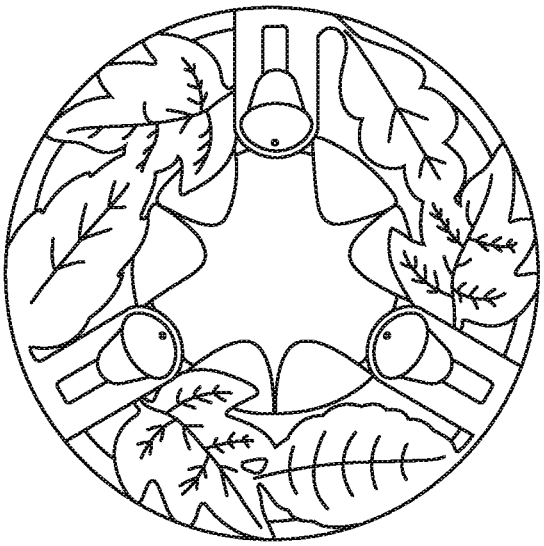
FIGS. 8A-D show 3D illustrations of top views of different decorative adjustable candle toppers according to various embodiments of the present disclosure. (A) shows a decorative topper body with pierced leaf motif on the body and an acorn-shaped lug; (B) shows a decorative topper body with a scrollwork heart motif and a beveled heart-shaped lug; (C) shows a decorative topper body with a scrollwork paisley motif and a pierced paisley-shaped lug; and (D) shows a decorative topper body with a pierced cat and dog motif on the domed body and an embossed heart-shaped lug.
Figure 8B:
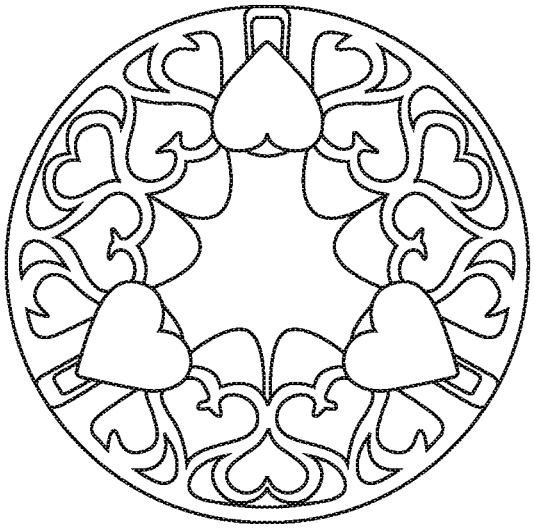
Figure 8C:
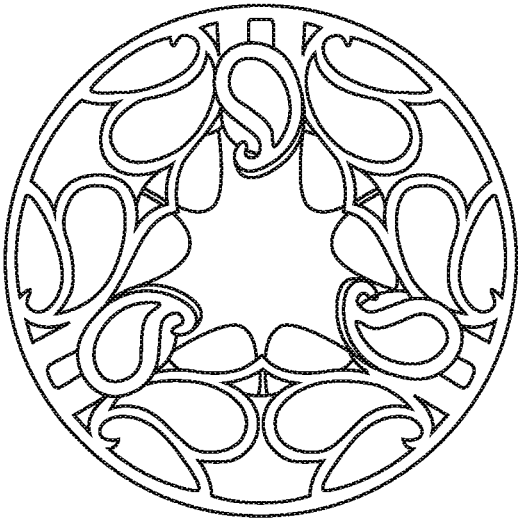
Figure 8D:
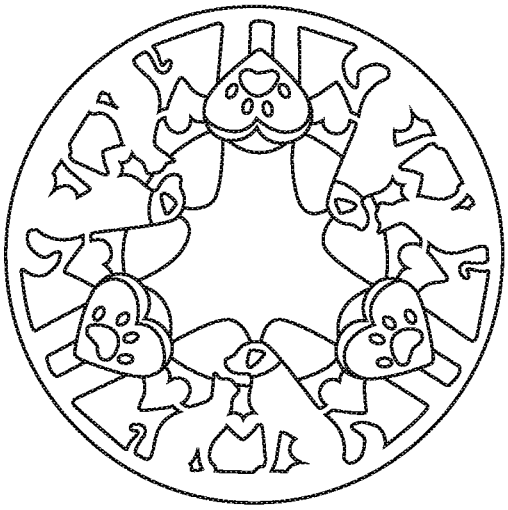

Decorative topper body 52 is constructed of one or more sufficiently thin pieces of material to define a cavity directly above the candle and a portion above the plane of the container rim. As shown in FIG. 8A, decorative topper body 52 is generally dome shaped with a substantially arcate profile defined by the angle from which guide members 56 and the design elements rise from the perimeter of flanged ring 80. The curvature of the arcate profile is defined by the degree of curvature, as described for candle topper 10.

Decorative topper body 52 includes several openings providing airflow to the candle: a central opening 54 and a plurality of fenestrations 68. Central opening 54 is positioned at a substantially central portion of decorative topper body 52.

Decorative adjustable candle topper 50 also includes three radially positioned and equally spaced adjustment assemblies 58. Each adjustment assembly 58 is mounted on and through topper body 52 and configured for sliding engagement along guide member 56. Adjustment assembly 58 is configured to adjustably stabilize candle flame and air flow in and around a candle wick, and may also secure decorative candle topper 50 to the inner wall/rim defining the mouth of a container. While decorative candle topper 50 has three adjustment assemblies 58, fewer or more adjustment assembles can be used depending on the shape or width of the container mouth, as discussed above for candle topper 10.

Each adjustment assembly 58 includes lug 60, connector 62, and abutment member 64. The components of adjustment assembly 68 can be constructed from a single type of material or several different types of material, as discussed above with respect to the material for constructing a topper body, generally.

Connector 62 threads (or passes through) guide means 56 longitudinally via connector slot 57 and can have any configuration suitable for threading engagement and for connecting lug 60 to abutment member 64. Connector 62 can also be configured for removably mounting topper body 52 on the rim of a container, as described above for candle topper 10.

Lug 60 has the shape of a stylized acorn, however, any shaped body capable of slidably engaging with guide member 56 can be used. In this case, at least a portion of lug 60 rests upon the upper surface of opposing sides of guide member 56. The material of one or both of lug 60 and guide member 56 can be adapted for sliding movement of lug 60 upwards and downwards along the curve of topper body 52. The material of one or both of lug 60 and guide member 56 can be adapted to resist sliding without an application of manual force, and thereby ensure that the lug 60, once positioned to a desired height remains at that height until it is manually moved again.

Lug 60 is operably coupled to abutment member 64 by connector 62. Connector 62 connects to abutment member 64 at a site that approximates the mid-point of abutment member 64, which has a curved configuration rendering it capable of abutting at least a portion of an inner wall of a container candle having a smaller diameter than perimeter of topper body 52.

A pair of baffles 66 extend from and are supported by abutment member 64. The connection site of connector 62 defines a central axis about which the pair are substantially bilaterally symmetrical. Each baffle 66 is positioned distally from connector 62 on abutment member 64, with the most distal portion of each baffle 66 being continuous with the distal edge of abutment member 64. As shown, baffle 66 has an arcate profile that rises from abutment member 64 at a substantially parallel curve to the curvature of decorative topper body 52.

The shape of baffle 66 is configured to baffle airflow through fenestrations, restrict heat flow from the candle through central opening 54 and/or reflect heat back towards the candle material. Baffle 66 has a semi-ovate petal shape (i.e., semioval) when viewed from above or below, with the narrowest point of the semioval directed toward the central axis of candle topper 50, however, as discussed above for candle topper 10, other shapes can be used provided baffle 66 can travel within the cavity underneath decorative topper body 52 along the full path defined by guide member 56, i.e., inwardly/upwardly or outwardly/downwardly, without interfering with the travel of an adjacent baffle.

The size and shape of abutment member 64 is configured so that, when all three lugs 60 are positioned at the upper stop of guide member 66, at least a portion of the distal edges of adjacent abutment members 64 align and the distal edges of their respective baffles 66 are brought into close contact on a transverse plane below the border of central opening 64. When viewed from above, with the lugs 60 so positioned, at least a portion of the uppermost edge of each baffle 66 can be visible through central opening 54 (e.g., FIG. 5A). In some cases, each of lugs 60 can be positioned so that the lateral edges of all three abutment members 64 fit together to form an annular rim underneath topper body 62 (as shown in FIG. 5B). As shown, each abutment member 64 is configured as one-third of the circumference of a circle with a radius that is shorter than the radius of the perimeter of topper body 52. The position of the upper portion of guide member 56 defining the upper stop of connector slot 57 can be based upon the diameter of this annular rim.

A user can manipulate the position of one or more of the adjustment assemblies 58 to improve burn efficiency over a single type of container, or over various differently sized containers and/or candles. For example, turning to FIGS. 6A-C, bottom views of candle topper 50 show the change in the relative positions of lugs 60, connectors 62, abutment members 64 and baffles 66 when adjustment assemblies 58 are adjusted to the following positions: to be in contact with the upper stop of connector slot 57, as shown in 6A, to be slightly above the midpoint of guide members 56, as shown in 6B, and to be slightly below the midpoint of guide members 56 as shown in 6C. These illustrations show a user can increase airflow through central opening 54 by sliding adjustment assemblies 58 downward along guide member 56.

Figure 7A:
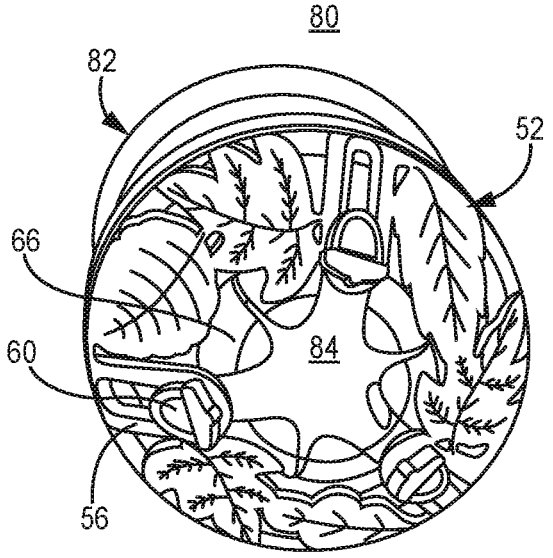
FIGS. 7A-D show 3D illustrations of a top view of the adjustable candle topper of FIG. 5 on a candle adjusted to show increasingly more of the candle material (shown in red): (A) shows the least amount of the candle material and a perspective view of the container; (B) shows more candle material than A; (C) shows more candle material than B; and (D) shows the most candle material.
Figure 7B:
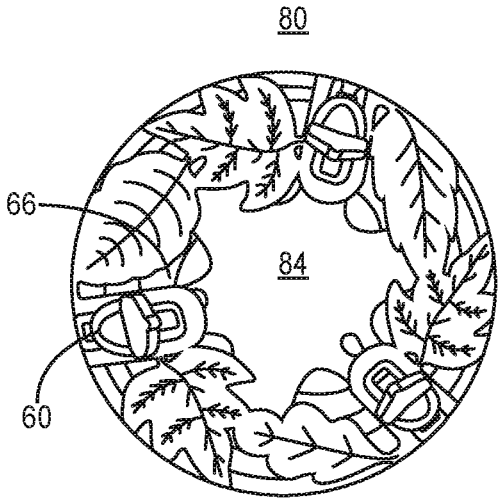
Figure 7C:
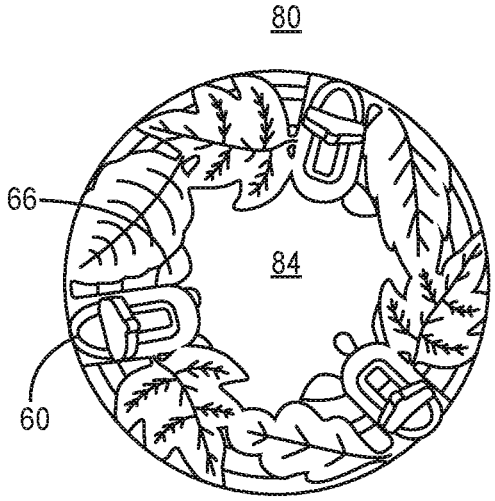
Figure 7D:
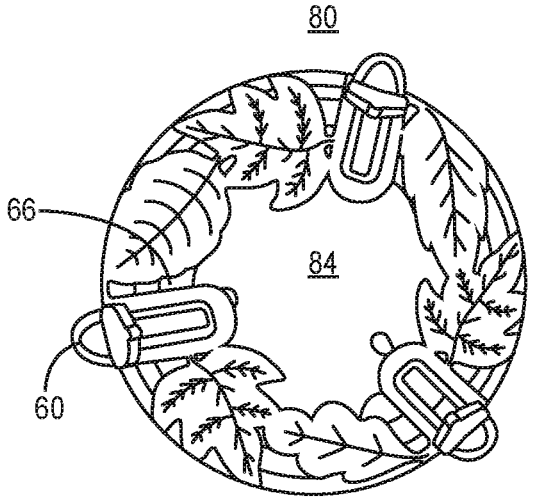

FIGS. 7A-D illustrate an adjustable candle topper 50 in use, attached to a container candle, according to one or more embodiments of the present disclosure. Container candle combination 80 includes decorative candle topper 50 stably mounted over lit container candle 82 having a rim that is substantially coextensive with the perimeter of decorative topper body 52. Adjustment assemblies 58 can be positioned to decrease the amount of heat reflected back to candle material 84 by manually pushing or pulling lug 60 to cause it to slide on the path defined by guide member 66 towards the perimeter. The sliding movement causes baffles 66 to travel from their first position within the cavity above the surface of the candle and or the mouth of the container, as shown in FIG. 7A, to a second position as shown in FIG. 7B, a third position, as shown in FIG. 7C, and the lowest position on guide member 56, as shown in FIG. 7D. Although each lug 60 is adjusted to a substantially identical position on decorative topper body 52, the position of each lug 60 can be independently controlled for adjusting airflow through a portion of decorative topper body 52. If a user notices that some of the melted candle material is pooling, each adjustment assembly 58 can be repositioned again to position baffles 66 over more of the candle material to ensure even melting of the candle material and efficient burning.

Figure 9A:
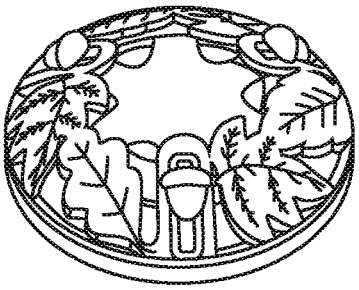
FIGS. 9A-C show 3D illustrations of angled side views of different decorative adjustable candle toppers according to various embodiments of the present disclosure. (A) Shows the a different view of the acorn-shaped lug of FIG. 8A; (B) shows a decorative surface of the flange of the topper of FIG. 8B; and (C) shows a decorative surface of the flange of the topper of FIG. 8C.
Figure 9B:
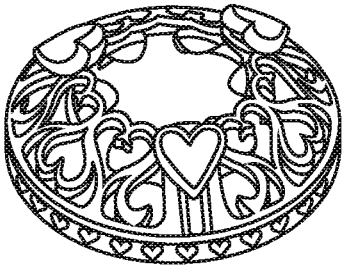
Figure 9C:
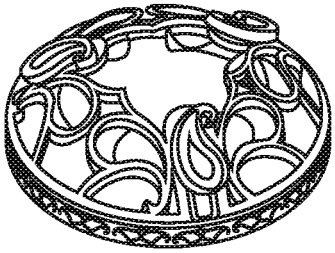
Figure 10:
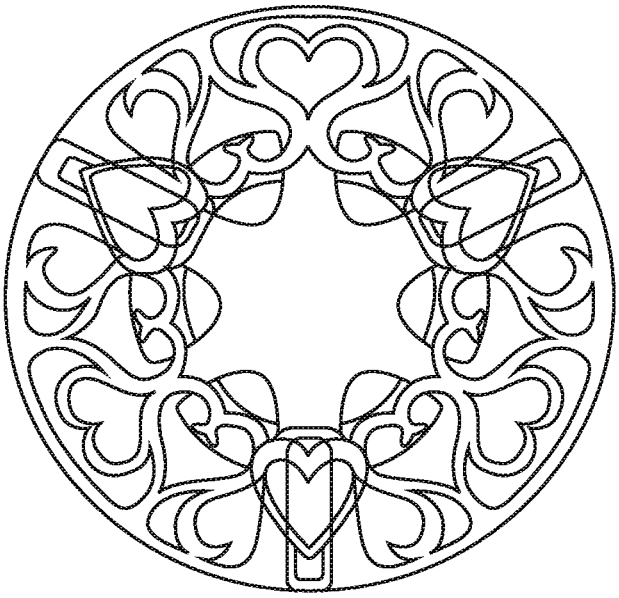
FIG. 10 is a 3D illustration showing a magnified view of the decorative candle topper of FIG. 8B.
Figure 11:
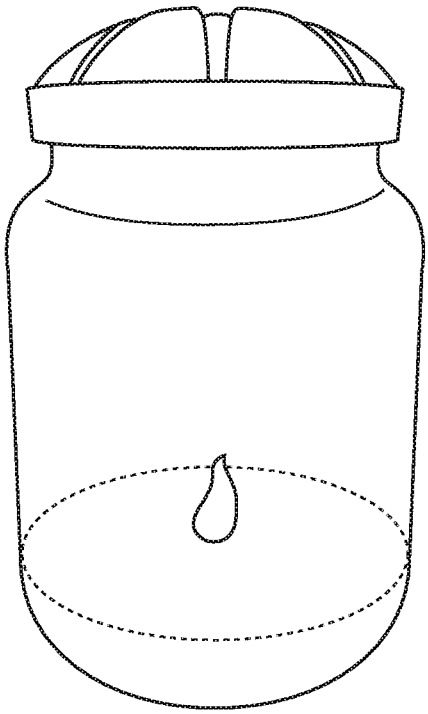
FIG. 11 Prior Art
FIG. 11 is a photograph of a non-adjustable candle topper of the prior art mounted on an apothecary jar candle.

FIGS. 8-10 illustrate one or more further embodiments of an adjustable candle topper, as described herein. An adjustable candle topper of the present disclosure can include any decorative elements that do not interfere with the adjustability of its moving components. Decorative elements can include one or more designs or patterns for the topper body according to a theme (e.g., holiday, season, or occasion). The design theme can be extended to one or more parts of the associated adjustment assemblies. For example, a fall-themed adjustable candle topper can have a topper body featuring a stylized leaves with acorns for the lugs, as shown in FIGS. 8A and 9A. A pet-themed adjustable candle topper can have a topper body featuring a recurring pattern of a cat and dog and a heart-shaped lug with an embossed stylized pawprint, as shown in FIG. 8D. Design elements of a topper body can be repeated on the lugs and flange, such as the hearts and paisleys shown in FIGS. 8-9B and C, respectively. The amount of material present in the topper body can be functional design elements as well. For example, the topper body can composed of thinner elements and feature large fenestrations, e.g., as achieved with the recurring pattern of paisleys shown in FIGS. 8-9C, or thicker elements but with a significant number of smaller fenestrations, as shown in FIGS. 8C, 9C, and 10. The size of the design elements and size and number of fenestrations can influence the level and pattern of the candle flame illumination (e.g., creating a pattern of aesthetically pleasing shadows) and how fragrance vaporizes from in the candle material and emanates from the candle (e.g., primarily through the central opening or through fenestrations). Thus, a decorative candle topper of the present invention can further contribute to the user's enjoyment of a candle.

Other embodiments of the present disclosure are possible. Although the description above contains much specificity, these should not be construed as limiting the scope of the disclosure, but as merely providing illustrations of some of the presently preferred embodiments of this disclosure. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form various embodiments. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

The foregoing description of various preferred embodiments of the disclosure have been presented for purposes of illustration and description. It is not intended to be exhaustive or to limit the disclosure to the precise embodiments, and obviously many modifications and variations are possible in light of the above teaching. The example embodiments, as described above, were chosen and described in order to best explain the principles of the disclosure and its practical application to thereby enable others skilled in the art to best utilize the disclosure in various embodiments and with various modifications as are suited to the particular use contemplated. It is intended that the scope of the disclosure be defined by the claims appended hereto.

Various examples have been described. These and other examples are within the scope of the following claims.

What is claimed is:

1. An adjustable topper for a container candle, the topper comprising:

a topper body capable of being seated over a mouth of a container candle and defining a cavity above the surface of candle, the topper body having:

(1) a centrally disposed opening; and (2) a plurality of radially-disposed guide members extending from the opening to the perimeter of the topper body; and a plurality of adjustment assemblies, each adjustment assembly comprising an abutment member supporting an airflow baffle configured to project into the cavity above the surface of the candle, wherein at least one adjustment assembly is mounted for sliding movement on one of the guide members, whereby the position of the airflow baffle in the cavity can be adjusted relative to the central opening by sliding the adjustment assembly along the guide member to stabilize a flame from the candle.

2. The adjustable topper of claim 1, wherein the topper body has a substantially arcate cross-section defining a domed cavity above the surface of the candle.

3. The adjustable topper of claim 2, wherein the airflow baffle rises from the abutment member at a curve parallel to the substantially arcate rise of the topper body.

4. The adjustable topper for claim 1, wherein the airflow baffle has a semioval shape.

5. The adjustable topper of claim 1, wherein each guide member includes a radially-extending slot, and the abutment member is coupled to a lug mounted on the surface of the guide member through the slot.

6. The adjustable topper of claim 5, wherein a connector threads the slot and operably couples the lug and the abutment member.

7. The adjustable topper of claim 6, wherein at least a portion of the connector is configured to mount the side wall of the container.

8. The adjustable topper of claim 1, wherein the topper body further includes a plurality of fenestrations.

9. The adjustable topper of claim 1, wherein the topper body further includes a flange.

10. The adjustable topper of claim 1, wherein the airflow baffle has a substantially arcate profile.

11. The adjustable topper of claim 1, wherein each abutment member is configured to support a pair of the airflow baffles.

12. The adjustable topper for claim 1, wherein the abutment member is configured to abut an inner side wall of a container having a mouth of smaller area than the area defined by the perimeter of the topper body.

13. The adjustable topper of claim 1, wherein the perimeter of the topper body is substantially circular.

14. The adjustable topper of claim 13, wherein the abutment member is configured as an arc of a circle having a radius that is shorter than the radius of the perimeter of the topper body and the midpoint of the arc is operably coupled to a lug mounted on the surface of the guide member through a slot defined by the guide member.

15. The adjustable topper of claim 14, wherein one or both of the guide member and the lug are configured to resist sliding without an application of manual force.

16. The adjustable topper of claim 1, wherein the adjustment assembly is configured such that sliding movement in the direction of the central opening results in at least a portion of the airflow baffle being visible through the central opening when viewed from above.

17. The adjustable topper of claim 1, wherein the topper body includes at least three radially-disposed guide members extending from the opening to the perimeter of the topper body and at least three adjustment assemblies, wherein each adjustment assembly is mounted for sliding movement on one of the guide members.

18. The adjustable topper of claim 17, wherein the perimeter of the topper body is substantially circular and the abutment members are configured as substantially equal arcs of a circle having a radius that is shorter than the radius of the perimeter of the topper body.

19. The adjustable topper of claim 18, wherein the midpoint of each arc is operably coupled to a lug mounted on the surface of the guide member through a slot defined by the guide member.

20. An adjustable candle topper kit comprising:

a container candle having at least one side wall defining a mouth, and an adjustable topper comprising:

a topper body capable of being seated over the mouth of the container and defining a cavity above the surface of the candle, the topper body having:

(1) a centrally disposed opening; and (2) a plurality of radially-disposed guide members extending from the opening to the perimeter of the topper body;

a plurality of adjustment assemblies, each adjustment assembly comprising an abutment member supporting an airflow baffle configured to project into the cavity above the surface of the candle, wherein at least one adjustment assembly is mounted for sliding movement on one of the guide members, whereby the position of the airflow baffle in the cavity can be adjusted relative to the central opening by sliding the adjustment assembly along the guide member.

* * * * *